US007484345B2

(12) United States Patent
Woods et al.

(10) Patent No.: US 7,484,345 B2
(45) Date of Patent: Feb. 3, 2009

(54) FILLING MACHINE

(75) Inventors: Elmer B. Woods, West Bend, WI (US); Bruce A. Bliefnick, Fond du Lac, WI (US); James P. Maslowski, Wauwatosa, WI (US)

(73) Assignee: PDC Facilities, Inc., Hartland, WI (US)

( * ) Notice: Subject to any disclaimer, the term of this patent is extended or adjusted under 35 U.S.C. 154(b) by 151 days.

(21) Appl. No.: 11/563,308

(22) Filed: Nov. 27, 2006

(65) Prior Publication Data

US 2007/0119121 A1 May 31, 2007

Related U.S. Application Data

(60) Provisional application No. 60/740,156, filed on Nov. 28, 2005, provisional application No. 60/847,735, filed on Sep. 28, 2006.

(51) Int. Cl.
*B65B 43/40* (2006.01)

(52) U.S. Cl. ..... 53/381.4; 53/468; 53/477; 53/266.1; 53/267; 53/284.7

(58) Field of Classification Search ..... 53/75, 53/468, 471, 477, 478, 266.1, 267, 281, 284.7, 53/381.4
See application file for complete search history.

(56) References Cited

U.S. PATENT DOCUMENTS 1,052,379 A 2/1913 Ranken
2,088,922 A 8/1937 Porteous
2,981,108 A 4/1961 Andersen et al.
3,469,685 A 9/1969 Baermann
3,662,517 A * 5/1972 Tascher et al. ..... 53/282

(Continued)

FOREIGN PATENT DOCUMENTS

DE 41 19 396 8/1992

(Continued)

OTHER PUBLICATIONS

DuPont Films; Tefzel Fluoropolymer film; Types LZ, CLZ, and CLZ-20;Specification Bulletin T 62-4; at least as early as Jan. 1, 2006; 4 pages.

(Continued)

*Primary Examiner*—Hemant M Desai
(74) *Attorney, Agent, or Firm*—Michael Best & Friedrich LLP

(57) ABSTRACT

A filling machine operable to dispense a fluid from a fluid supply to a container having an opening and a cap configured to cover the opening. The filling machine includes a housing that defines a fill chamber and a cap removal assembly at least partially located within the fill chamber. The cap removal assembly is operable to remove the cap from the opening of the container within the fill chamber. The filling machine further includes a fill line assembly having an inlet and an outlet. The inlet is configured to be coupled to the fluid supply and the outlet is located within the fill chamber. The outlet is configured to be placed in fluid communication with the opening of the container. The fill line assembly is removably coupled to the filling machine, and fluid flowing from the fluid supply to the container flows through the fill line assembly.

25 Claims, 14 Drawing Sheets

U.S. PATENT DOCUMENTS 3,695,104 A 10/1972 Mannherz et al.
3,750,468 A 8/1973 Grauer
3,874,430 A 4/1975 Lansdale
3,896,605 A 7/1975 Chevalier
3,926,229 A 12/1975 Scholle
4,003,188 A 1/1977 Lau
4,010,786 A 3/1977 Aguettant et al.
4,077,182 A 3/1978 Papaluca
4,112,762 A 9/1978 Turner et al.
4,120,134 A 10/1978 Scholle
4,283,901 A * 8/1981 Schieser et al. ..... 53/75
4,388,834 A 6/1983 Schmoock
4,417,607 A 11/1983 Scholle et al.
4,446,674 A 5/1984 Inada
4,452,030 A 6/1984 Inada
4,458,734 A * 7/1984 Scholle et al. ..... 141/5
4,481,753 A 11/1984 Rutter et al.
4,510,736 A 4/1985 Müller
4,524,563 A 6/1985 Sassi
4,583,352 A 4/1986 Heron
4,592,886 A 6/1986 Mannherz
4,598,529 A 7/1986 Pongrass et al.
4,726,170 A 2/1988 Sawa et al.
4,754,786 A 7/1988 Roberts
4,805,378 A 2/1989 Anderson
4,832,096 A 5/1989 Kohlbach
4,842,028 A 6/1989 Kaufman et al.
4,856,261 A 8/1989 Hackett et al.
4,877,033 A 10/1989 Seitz, Jr.
4,893,659 A 1/1990 Löliger
4,942,716 A 7/1990 Anderson
4,964,261 A 10/1990 Benn
4,991,633 A 2/1991 Wong
5,099,895 A 3/1992 Loeliger
5,157,975 A 10/1992 Tanaka et al.
5,227,105 A 7/1993 Eucker et al.
5,301,714 A 4/1994 Johnson
5,403,533 A 4/1995 Meier
5,465,767 A 11/1995 Harms et al.
5,474,113 A 12/1995 Rademacher et al.
5,477,896 A 12/1995 Lucas
5,479,955 A 1/1996 Roodvoets et al.
5,493,845 A 2/1996 Adolf et al.
5,537,803 A * 7/1996 Olsen ..... 53/467
5,641,004 A 6/1997 Py
5,664,399 A 9/1997 Cassou
5,731,527 A 3/1998 Van Cleve
5,773,723 A 6/1998 Lewis et al.
5,814,739 A 9/1998 Van Cleve
5,865,221 A 2/1999 Ludwig et al.
5,881,535 A 3/1999 Gliniecki et al.
5,881,869 A 3/1999 Hudson
5,918,285 A 6/1999 Van der Pol
6,044,618 A 4/2000 Cassou et al.
6,070,622 A 6/2000 Rutter
6,176,525 B1 1/2001 McMillan et al.
6,256,964 B1 * 7/2001 Drevfors ..... 53/426
6,394,992 B1 5/2002 Sjöholm
6,450,042 B1 9/2002 Lanham et al.
6,450,215 B1 9/2002 Willemstyn et al.
6,451,012 B2 9/2002 Dobak, III
6,474,175 B2 11/2002 Davies et al.
6,606,917 B2 8/2003 Sund et al.
6,658,824 B2 * 12/2003 Nussbaumer et al. ..... 53/505
6,689,303 B2 2/2004 Seki et al.
6,712,963 B2 * 3/2004 Schick ..... 210/198.2
6,725,726 B1 4/2004 Adolfs et al.
6,742,321 B2 6/2004 Gates
6,776,053 B2 8/2004 Schlosser et al.
6,823,654 B2 11/2004 Gates et al.
7,165,467 B2 1/2007 Klees et al.
7,264,771 B2 * 9/2007 Bilstad et al. ..... 422/22
7,326,355 B2 * 2/2008 Graetz et al. ..... 210/806
7,331,156 B2 * 2/2008 Hartness et al. ..... 53/251
2002/0139199 A1 10/2002 Lanham et al.
2003/0023181 A1 1/2003 Mault
2003/0098069 A1 5/2003 Sund et al.
2003/0178097 A1 9/2003 Willstumpf
2003/0230521 A1 12/2003 Schick
2004/0094229 A1 5/2004 Danby et al.
2005/0011287 A1 1/2005 Schlosser et al.
2005/0161614 A1 * 7/2005 Bilstad et al. ..... 250/455.11
2006/0010991 A1 1/2006 Woods et al.
2006/0106365 A1 5/2006 Lane et al.
2006/0159155 A1 7/2006 Lantz et al.
2007/0187317 A1 * 8/2007 Graetz et al. ..... 210/321.6

FOREIGN PATENT DOCUMENTS

EP 1281349 2/2003
FR 2 389 538 12/1978
GB 1119055 7/1968
GB 2 248 599 4/1992
JP 2001327490 11/2001
JP 2003000597 1/2003

OTHER PUBLICATIONS

Micro Motion® Flowmeters Product Data Sheet (Jun. 2004), pp. 1-20.
Micro Motion® T-Series Straight-Tube Mass Flow and Density Meters (Feb. 2004), pp. 1-20.
Micro Motion; Model D and DT Mass Flow and Density Sensors; Product Data Sheet; Mar. 2005; 36 pages.
Teflon and Tefzel High-Performance Films;website: http:/www2.dupont.com/Teflon_Industrial/en_US/products/product_by_type/films/; printed on May 18, 2006; 1 page.
Teflon Finishes in the Semiconductor Industry; website: HTTP//72.14.203.104/search?q=cache:1Xr2Fjt_3uIJ:www.fabtechinc.com/pdfiles/ETFEArticle.pdf+tefzel+removal&hl=en&gl=. . . ; May 18, 2006;8 pages; Reprinted from Cleanroom Technology; Jul. 1999.
Teflon Industrial; Six Basic Types of Teflon Coatings; website: http://www2.dupont.com/Teflon_Industrial/en_US/products/selection_guides/coatings.html; printed on May 18, 2006; 7 pages.

* cited by examiner

FILLING MACHINE

CROSS-REFERENCE TO RELATED APPLICATIONS

This application claims priority to U.S. Provisional Patent Application No. 60/740,156, filed Nov. 28, 2005 and to U.S. Provisional Patent Application No. 60/847,735, filed Sep. 28, 2006, the entire contents of all of which are hereby incorporated by reference herein.

BACKGROUND

The present invention relates to filling machines.

Automated fill systems and filling machines are used for transferring fluids from a reservoir to containers. Typically, these automated systems incorporate a flow meter to accurately control the amount of fluid introduced into each container, either by mass (weight) or volume. These systems are typically used in the pharmaceutical, biopharmaceutical, chemical, and food packaging industries. The automated systems also generally include a stop valve controlled by the flow meter and a nozzle used to transfer the measured amount of fluid to a container.

In many industries, such as pharmaceutical and biopharmaceutical, it is important to clean, sterilize, and validate permanent (i.e., non-disposable process piping) conduits within the system to prevent cross-contamination when the fluid reservoir is changed to introduce a different fluid through the system. This is referred to in the industry as changing batches. When changing batches, it is common to inject cleaning chemicals, pure water, and steam through the conduits to clean and sterilize them. Conduit portions may also have to be disassembled for cleaning and sterilization. The cleaning and sterilizing must also be validated or certified as sufficiently aseptic prior to proceeding with the next batch. This results in a process that is time consuming, labor intensive and costly due to the associated downtime of the system.

Often, systems and filling machines have added additional valves and fittings at multiple locations along the conduits of the system to facilitate a clean-in-place (CIP) or steam-in-place (SIP) process, and to allow cleaning and validation over smaller sections of the system. For example, if the entire system cannot be validated, the contamination can be isolated to a specific section and then only that specific section can be re-cleaned. In other words, isolation valves allow one or more sections of the flow path to be cut off to allow for further cleaning of only the flow path sections that require cleaning. Although this arrangement simplifies cleaning, sterilizing, and validating between batches, it does not eliminate the costly, labor intensive, and time consuming cleaning process with respect to the flow meter and other process piping of the filling machine.

In addition, it is often desirable to sterilize the container and the fluid after the fluid has been placed into the container. Sterilizing the fluid and container after the fluid is placed into the container is known as terminal sterilization. Autoclaving is one method of terminal sterilization. Autoclaving typically includes the use of pressurized steam to sterilize the container and fluid. However, biopharmaceuticals are typically not suited for such terminal autoclaving because the pressurized steam, which is often superheated, can destroy living organisms in the biopharmaceutical solution. Therefore, manual methods for terminal sterilization have been developed. Such methods are labor intensive, time consuming, and costly.

SUMMARY

The present invention provides a filling machine operable to dispense a fluid from a fluid supply to a container having an opening and a cap configured to cover the opening. The filling machine includes a housing that defines a fill chamber and a cap removal assembly at least partially located within the fill chamber. The cap removal assembly is operable to remove the cap from the opening of the container within the fill chamber. The filling machine further includes a fill line assembly having an inlet and an outlet. The inlet is configured to be coupled to the fluid supply and the outlet is located within the fill chamber. The outlet is configured to be placed in fluid communication to the opening of the container. The fill line assembly is removably coupled with the filling machine, and fluid flowing from the fluid supply to the container flows through the fill line assembly.

In another embodiment, the invention provides a filling machine operable to dispense a fluid from a fluid supply to a container having a body portion and a fill conduit extending from the body portion. The fill conduit defines an opening of the container. The filling machine includes a housing that defines a fill chamber and an aperture configured to receive the fill conduit to position at least a portion of the fill conduit within the fill chamber. The filing machine further includes a fill line assembly and a conduit sealing assembly operable to seal the fill conduit. The fill line assembly includes an inlet and an outlet. The inlet is configured to be coupled to the fluid supply and the outlet is located within the fill chamber. The outlet is configured to be placed in fluid communication with the opening of the container. The fill line assembly is removably coupled with the filling machine, and fluid flowing from the fluid supply to the container flows through the fill line assembly.

In yet another embodiment, the invention provides a method of operating a filling machine. The method includes inserting a fill conduit of a container into a fill chamber of the fillings machine such that a body portion of the container remains outside of the fill chamber, and inserting a cap that covers an opening of the container defined by the fill conduit into a cap removal assembly of the filling machine. The method further includes removing the cap from the opening of the fill conduit, dispensing a fluid from a fluid supply into the container, and sealing the fill conduit of the container.

In yet another embodiment, the invention provides a method of installing and removing a fill line assembly from a filling machine. The filling machine is operable to dispense a fluid from a fluid supply to a container. The method includes coupling an inlet of the fill line assembly to the fluid supply, routing a flexible fill line of the fill line assembly through a portion of the filling machine, and positioning an outlet of the fill line assembly within a fill chamber of the filling machine such that the fluid passes through the fill line assembly without directly contacting other surfaces of the filling machine. The method further includes removing the fill line assembly from the filling machine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
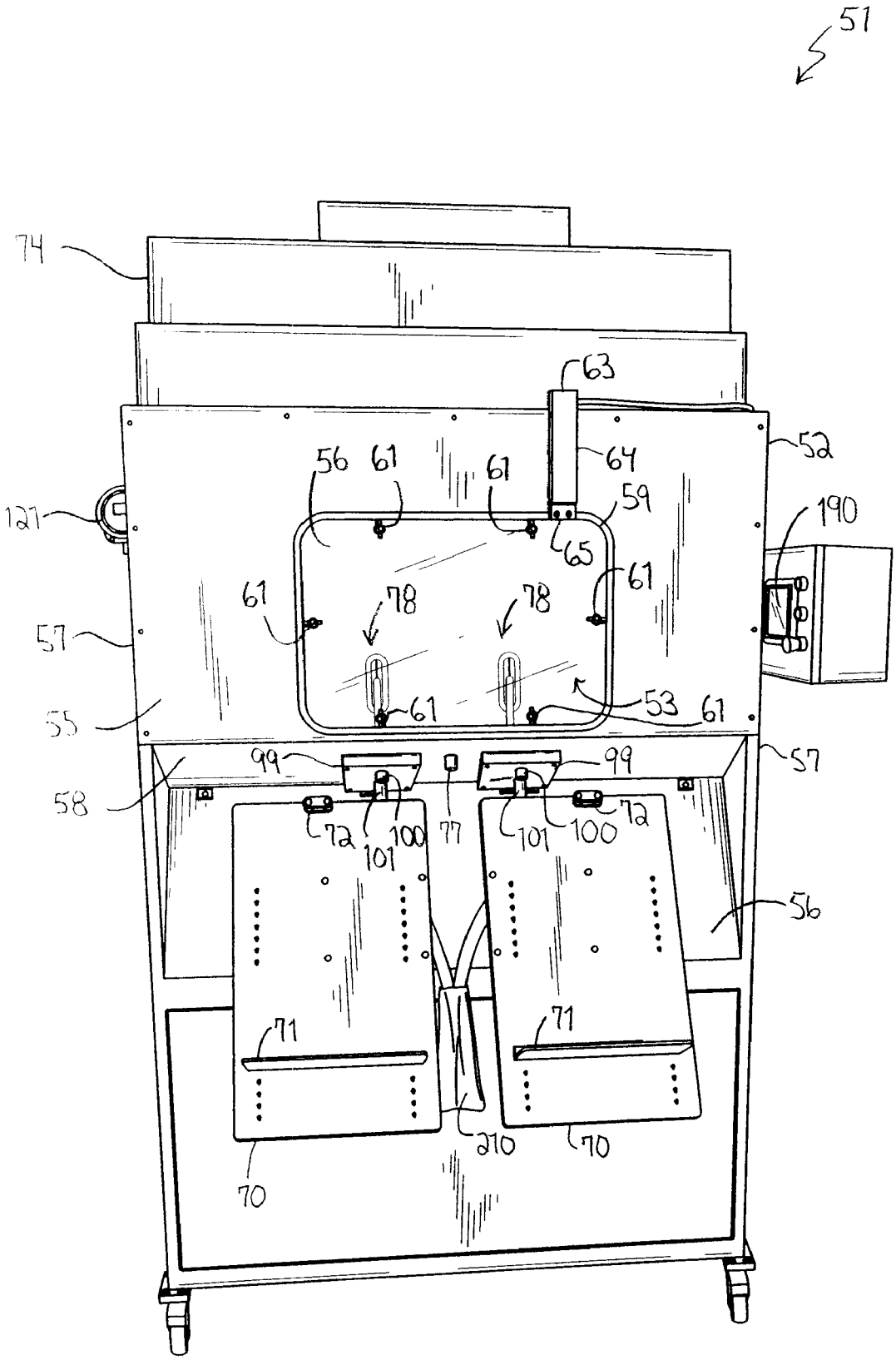
FIG. 1 is a front view of a filling machine embodying the present invention.

FIG. 1 illustrates a filling machine 51 operable to fill containers, such as thermoplastic bags including, intravenous solution bags (IV bags), pharmaceutical bags, and the like with any suitable fluid such as pharmaceutical solutions, media solutions, biopharmaceuticals, chemicals, foods, etc. In other embodiments, the filling machine can be utilized to fill other suitable containers. The filling machine 51 includes a housing 52 that defines a substantially aseptic fill chamber 53. The fill chamber 53 is defined by a front wall 55, a rear wall 56, side walls 57, and a bottom wall 58. The illustrated front wall 55 includes a viewing window 59 that includes a plurality of latches 61. The latches 61 couple the viewing window 59 to the front wall 55. A sensor 63 includes a portion 64 that is coupled to the front wall 55 and a portion 65 that is coupled the viewing window 59. The sensor 63 signals whether the viewing window 59 is in the position as shown in FIG. 1 or if the viewing window 59 has been removed from the front wall 55.

The illustrated rear wall 56 is located at approximately a 30 degree angle relative to the front wall 55 and slopes from the rear of the filling machine 51 towards the front. In other constructions, the rear wall can be located at any suitable angle relative to the front wall, and in one construction the rear wall is located at approximately 90 degrees relative to the front wall 55. A bag support apparatus 70 is coupled to the rear wall 56 outside of the fill chamber 53. The illustrated bag support apparatus 70 includes an adjustable bag support 71 and a bag handle support 72.

An air handling unit 74 is coupled to the top of the filling machine 51 and is in fluid communication with the fill chamber 53. The air handling unit 74 includes a fan and an air filter. In one construction, the air filter is a HEPA filter that creates a class 100 environment within the substantially aseptic fill chamber 53. The air handling unit 74 is operable to provide an air flow to the fill chamber 53 to maintain the fill chamber 53 under a positive pressure with respect to an atmospheric pressure. In one construction, the air handling unit 74 is configured to achieve laminar flow (i.e. no flow eddies) through the fill chamber 53. A pressure measuring device 76 (FIG. 5) is utilized to measure a difference between the fill chamber pressure and the atmospheric pressure. A test port 77 (FIG. 1) extends through the bottom wall 58 of the fill chamber 53. The test port 77 can be placed in fluid communication with an air monitor, or other similar device, to test or monitor the air quality within the substantially aseptic fill chamber 53.

With continued reference to FIG. 1, container filling stations 78 are located within the fill chamber 53. While the illustrated filling machine 51 includes two filling stations 78, it should be understood that the filling machine 51 may include any suitable number of filling stations 78. Both of the filling stations 78 are the substantially the same, and therefore only one of the filling stations 78 will be described in detail below.

Figure 2:
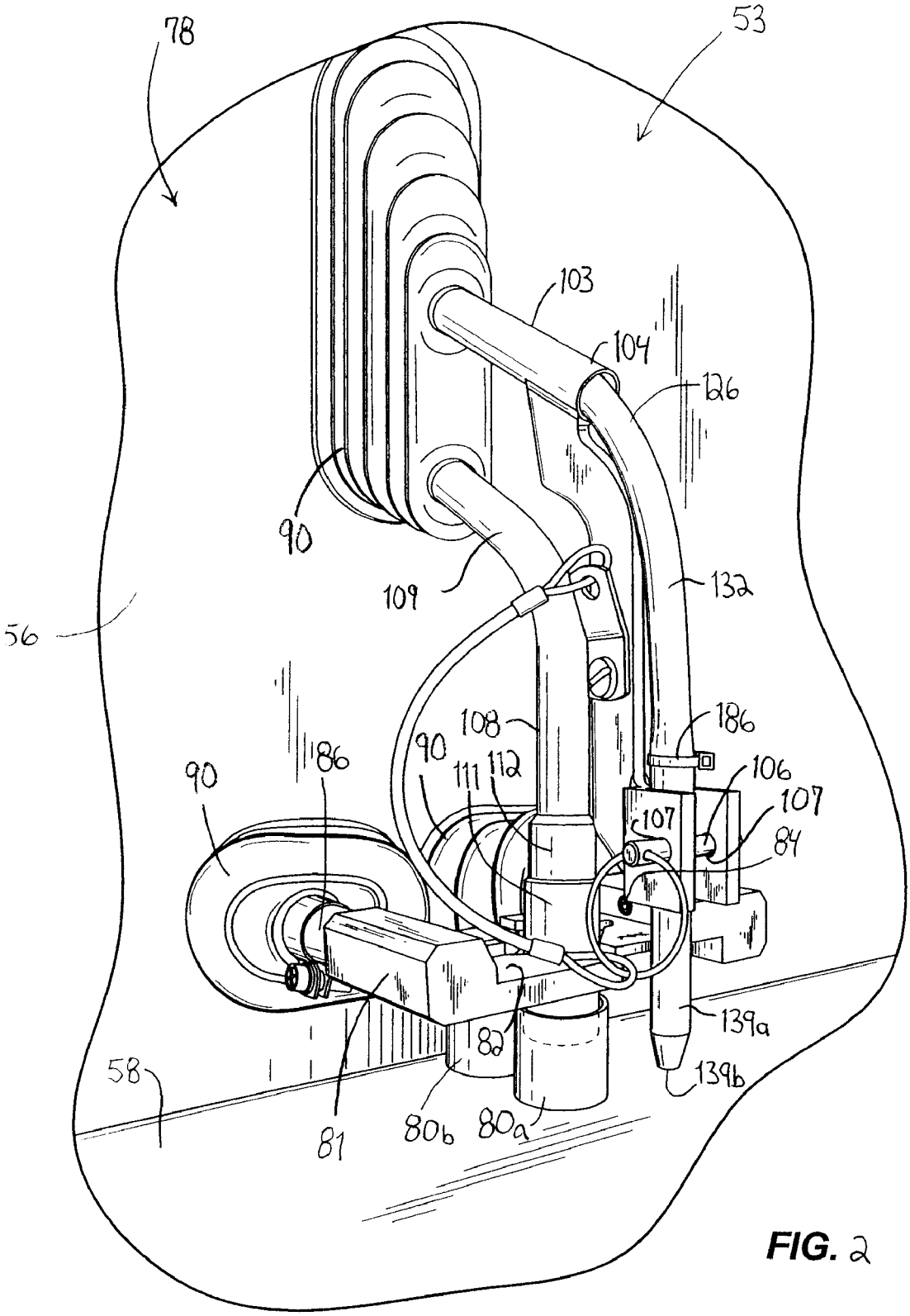
FIG. 2 is an enlarged view of a filling station of the filling machine of FIG. 1.
Figure 12:
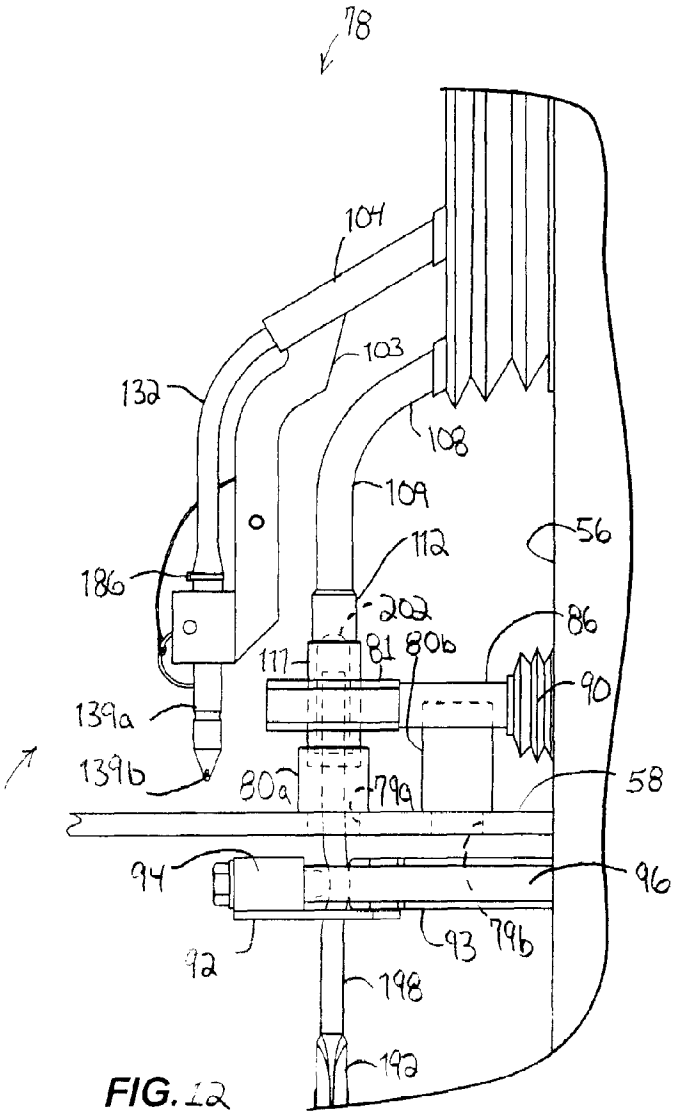
FIGS. 11-18 illustrate a method of operating the filling machine of FIG. 1.

Referring to FIGS. 2 and 12, the bag filling station 78 includes a corresponding conduit insertion aperture 79*a* and a cap disposal aperture 79*b* that extend through the bottom wall 58 of the fill chamber 53. A hollow sleeve 80*a* is aligned with the aperture 79*a*, and a hollow, sleeve 80*b* is aligned with the aperture 79*b*.

Figure 14:
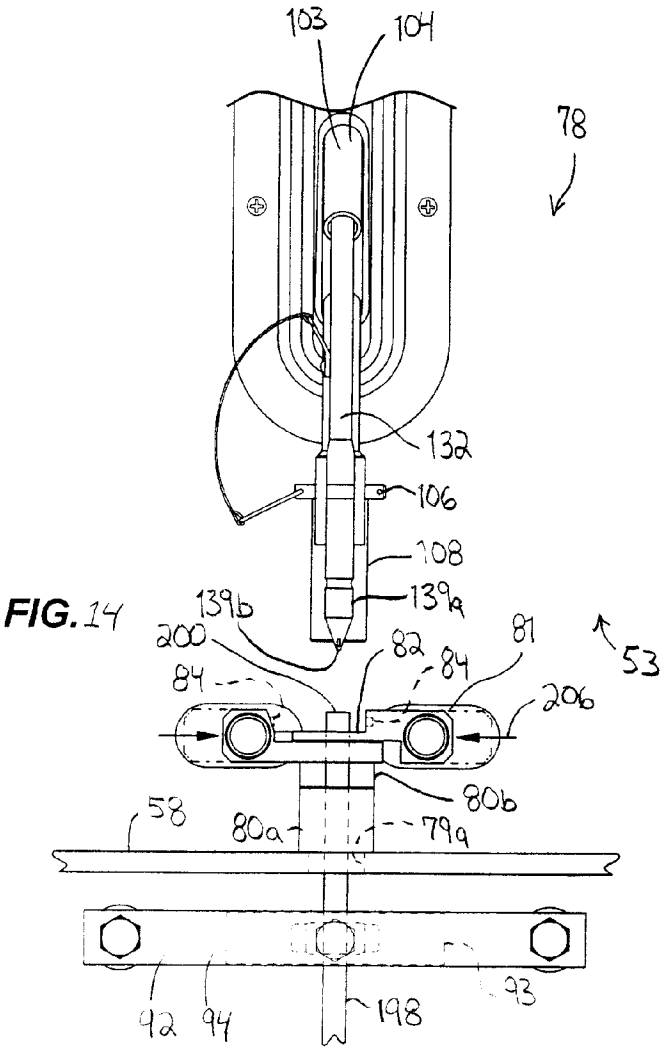

Referring to FIG. 2, the bag filling station 78 includes a tube or fill conduit support clamp 81. The tube support clamp 81 includes a tube receiving portion 82 and a sensor 84 located adjacent the tube receiving portion 82. Arms 86 extend from the tube receiving portion 82 through openings in the rear wall 56. Seals 90 inhibit fluid communication though the openings between the fill chamber 53 and the exterior atmosphere. The arms 86 are coupled to an actuator 88 (FIG. 3) that moves the tube support clamp 81 between an open position (FIG. 17) and a closed position (FIG. 14). In the illustrated construction, the actuator 88 is a pneumatic actuator, and in other constructions the actuator can be any suitable actuator, such as an electric actuator and the like.

Figure 4:
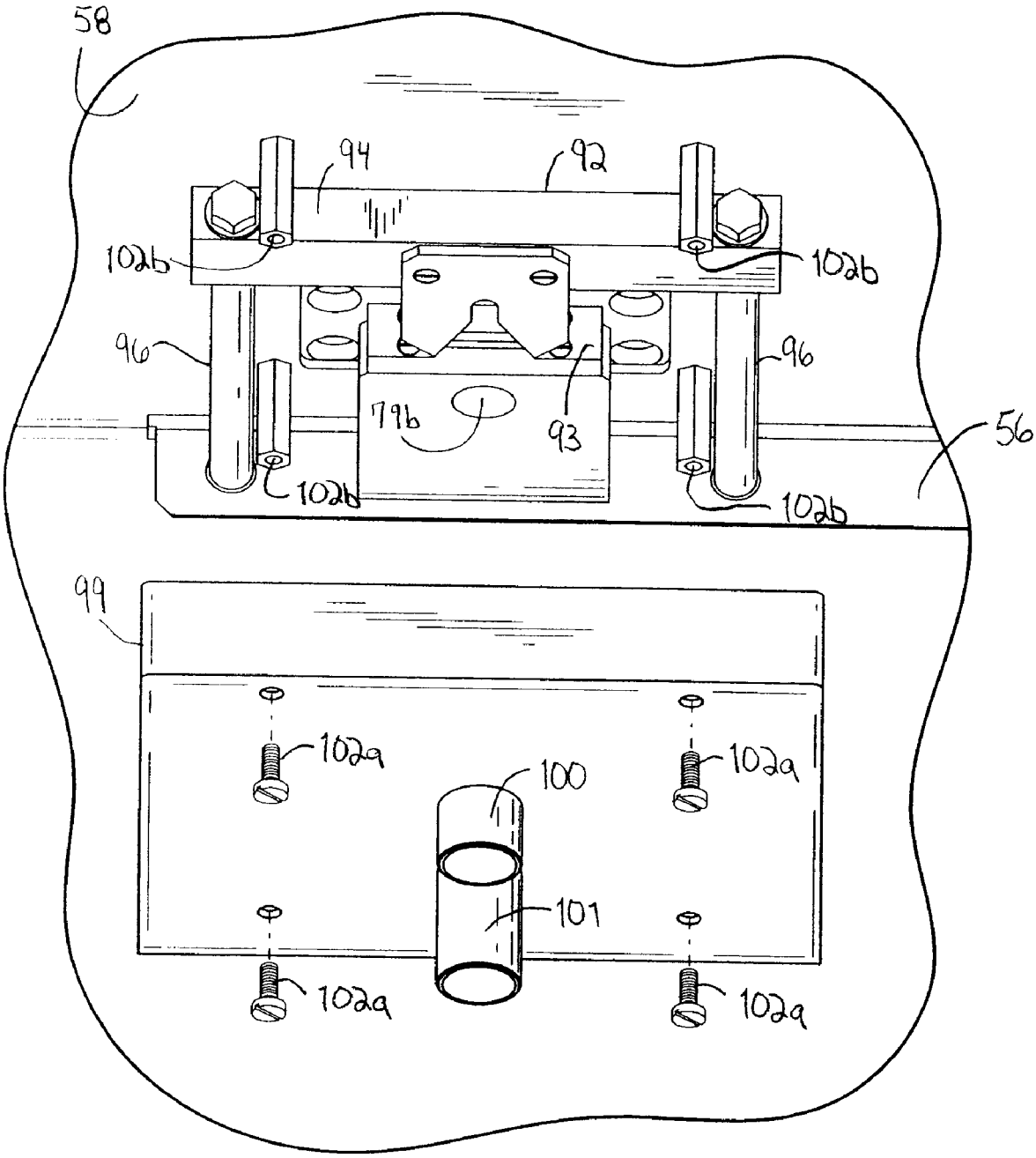
FIG. 4 is an enlarged front view illustrating a conduit sealing assembly of the filling machine of FIG. 1.
Figure 19:
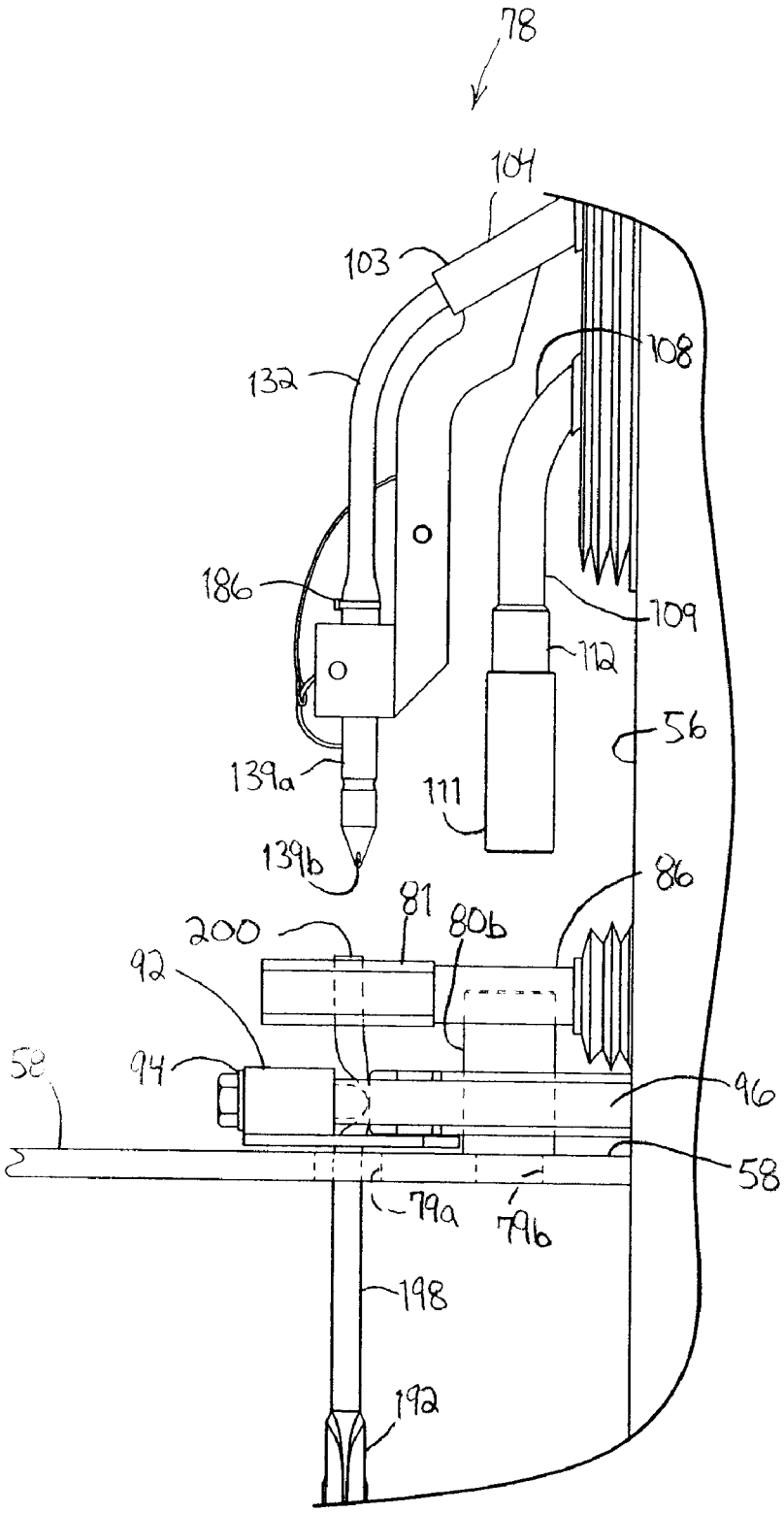
FIG. 19 illustrates an alternative construction of the filling machine of FIG. 1.

Referring to FIGS. 1 and 4, a tube or conduit sealing assembly 92 is located outside of the fill chamber 53, beneath the bottom wall 58. In other constructions, the sealing assembly 92 can be located within the fill chamber 53, as illustrated in FIG. 19, generally between the tube support clamp 81 and the bottom wall 58. However, by having the sealing assembly 92 outside of the fill chamber 53, the number of apertures or openings that extend through exterior walls of the fill chamber 53 to the external environment are reduced.

Figure 16:
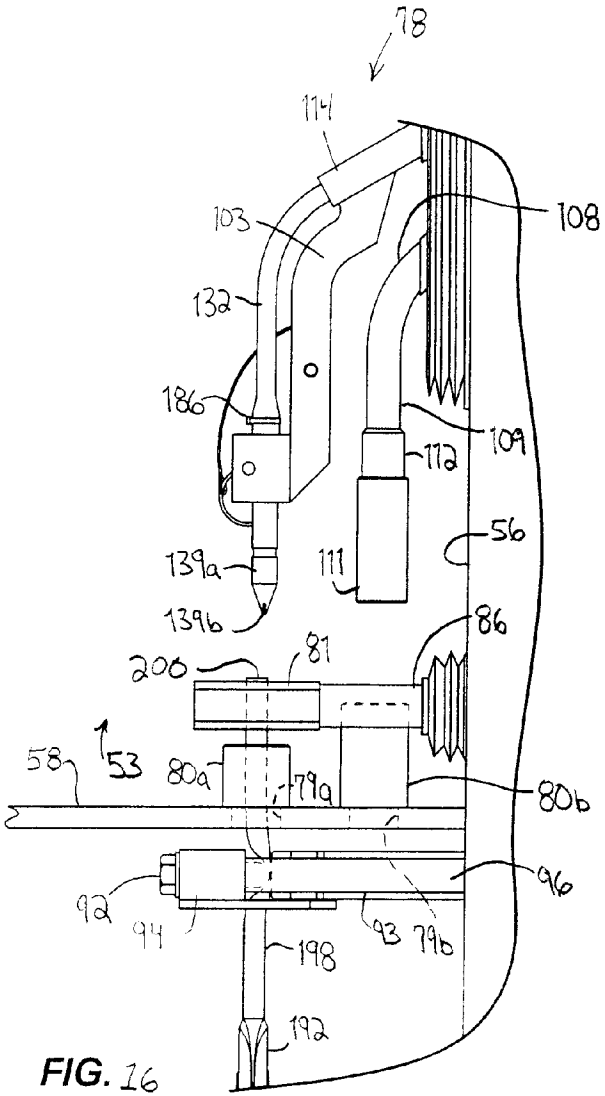

Referring to FIG. 4, the sealing assembly 92 includes a fixed member 93 and a movable member 94. The movable member 94 includes two arms 96 that extend through openings in the rear wall 56. The two arms 96 are coupled to an actuator 98 (FIG. 3) that moves the sealing assembly 92 between an open position (FIG. 15) and closed position (FIG. 16). In the closed position, the sealing assembly 92 is operable to create a radio frequency (RF) seal in a thermoplastic tube. While the illustrated sealing assembly 92 is a radio frequency sealing assembly, in other constructions other suitable sealing assemblies can be utilized, such as heat sealing assemblies. In yet other constructions, the sealing assembly can be omitted.

Referring to FIGS. 1 and 4, a cover 99 is used to enclose the sealing assembly 92. The cover 99 includes hollow sleeves 100 and 101. The sleeve 100 is aligned with the aperture 79*a* (FIG. 11) and the sleeve 101 is aligned with the aperture 79*b*. The cover 99 is coupled to the bottom wall 58 of the fill chamber 53 using screws 102*a* that are received in corresponding apertures 102*b*.

Referring to FIG. 2, the filling station 78 also includes a fill line bracket 103 that includes a tubular portion 104. A pin 106 is received by apertures 107 in the fill line bracket 103. The filing station 78 further includes a cap removal assembly 108. The illustrated cap removal assembly 108 includes a cap removal tube 109 that is located adjacent the fill line bracket 103. The cap removal tube 109 is a generally hollow member and includes a first portion 111 with a diameter and a second portion 112 with a diameter that is less than the diameter of the first portion 111. The cap removal tube 109 is in fluid communication with a vacuum generation device of the cap removal assembly, such that the vacuum generation device is operable to create a vacuum within the cap removal tube 109. In other constructions, the cap removal assembly can take other suitable forms. For example, in one construction, the removal assembly is operable to remove a cap that is hingedly coupled to the container (i.e. a flip-open type cap). In such constructions, the cap removal assembly can be operable to replace the cap.

Figure 3:
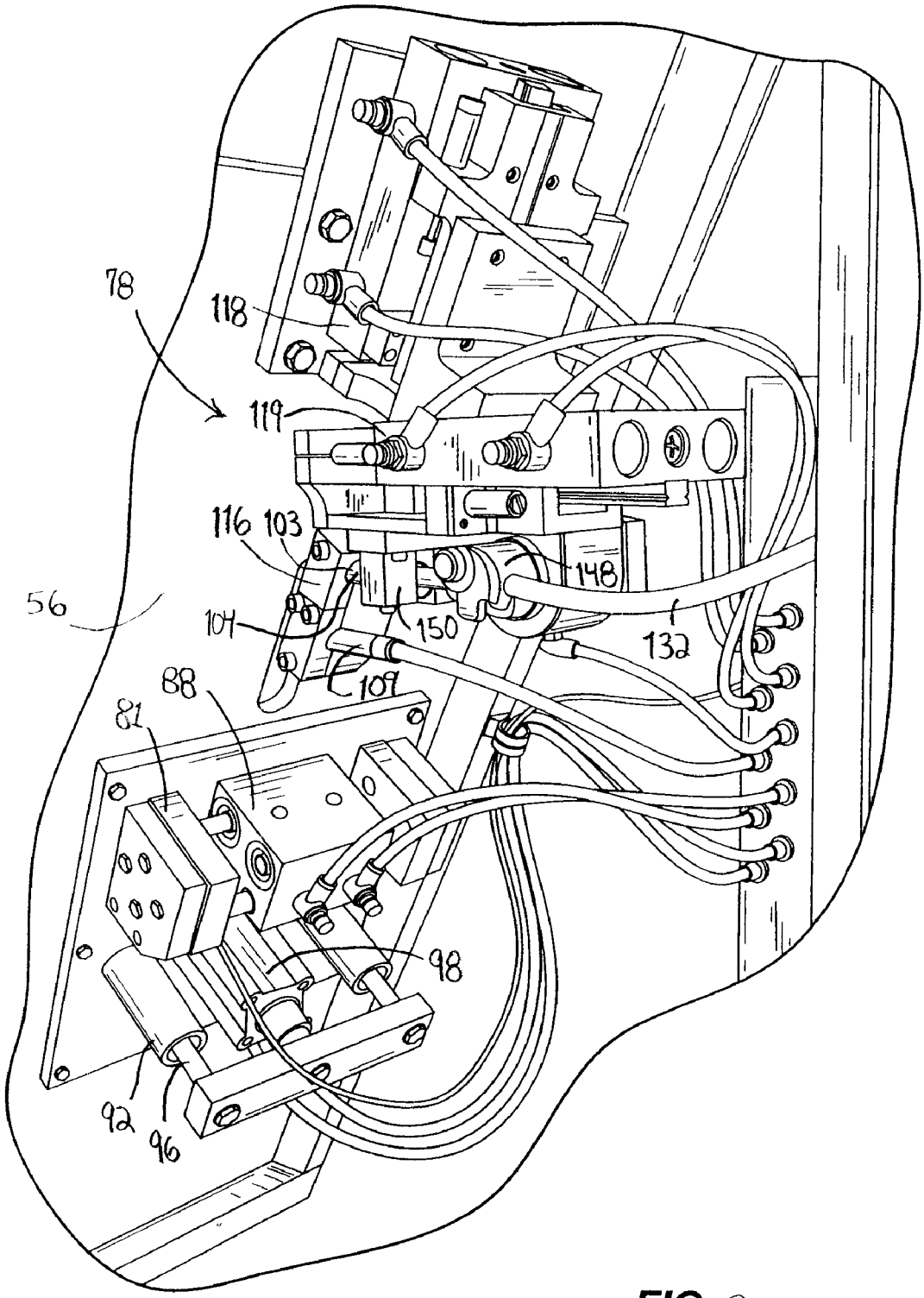
FIG. 3 is an enlarged rear view of the filling station of FIG. 2.

Referring to FIGS. 2 and 3, a carrier assembly 116, which is a clamp in the illustrated construction, couples the fill line bracket 103 and the cap removal tube 109, such that the fill line bracket 103 and the cap removal tube 109 move in unison. A first actuator 118 and a second actuator 119 are operable to move the carrier 116. The first actuator 118 is operable move the carrier 116 in directions parallel to the rear wall 56 and the second actuator 119 is operable to move the carrier 116 in horizontal directions. While the illustrated actuators 118, 119 are air operated or pneumatic actuators, it should be understood that any suitable actuator can be utilized, such as electrically operated actuators.

Figure 5:
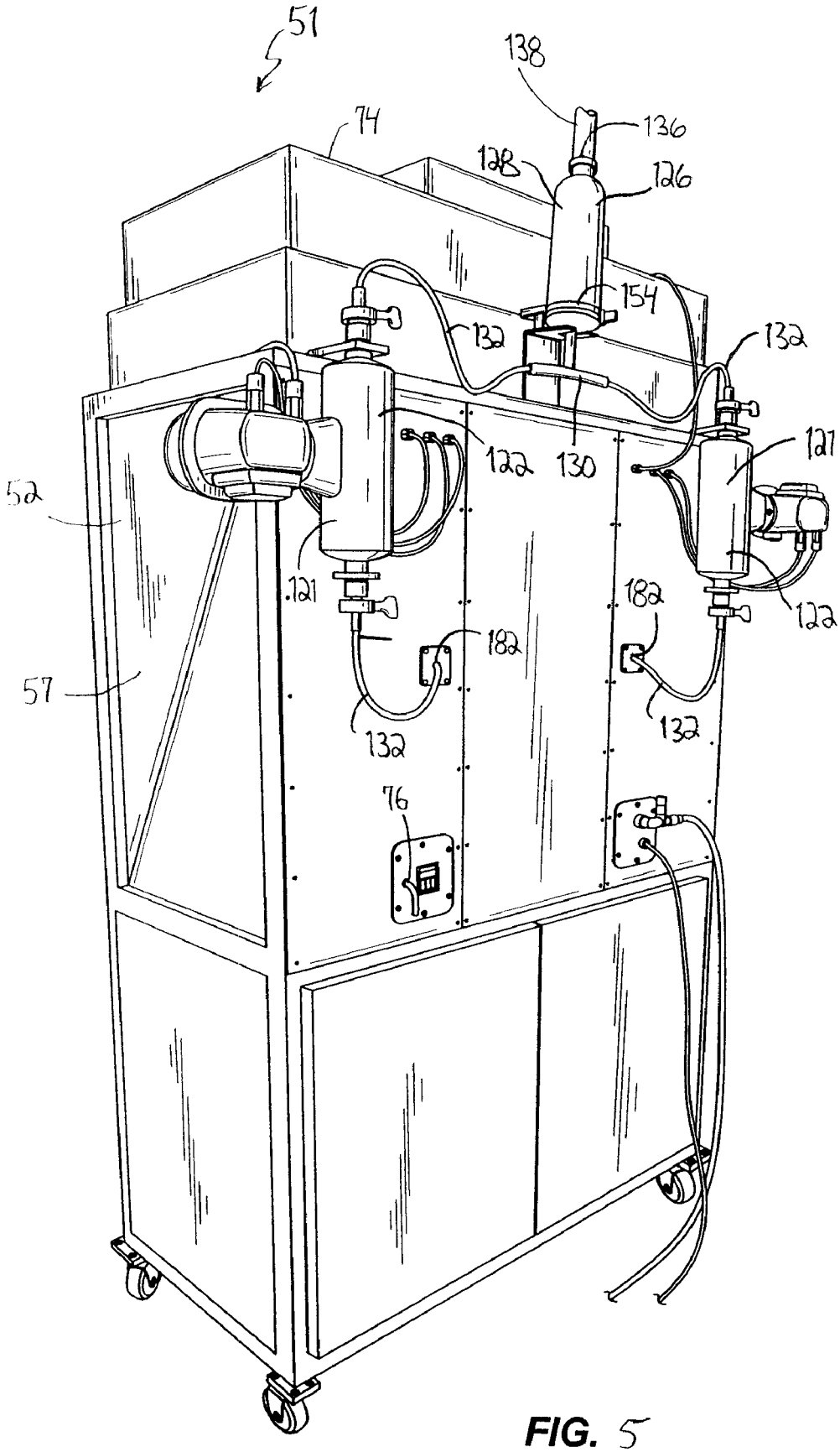
FIG. 5 is a rear perspective view of the filling machine of FIG. 1.
Figure 6:
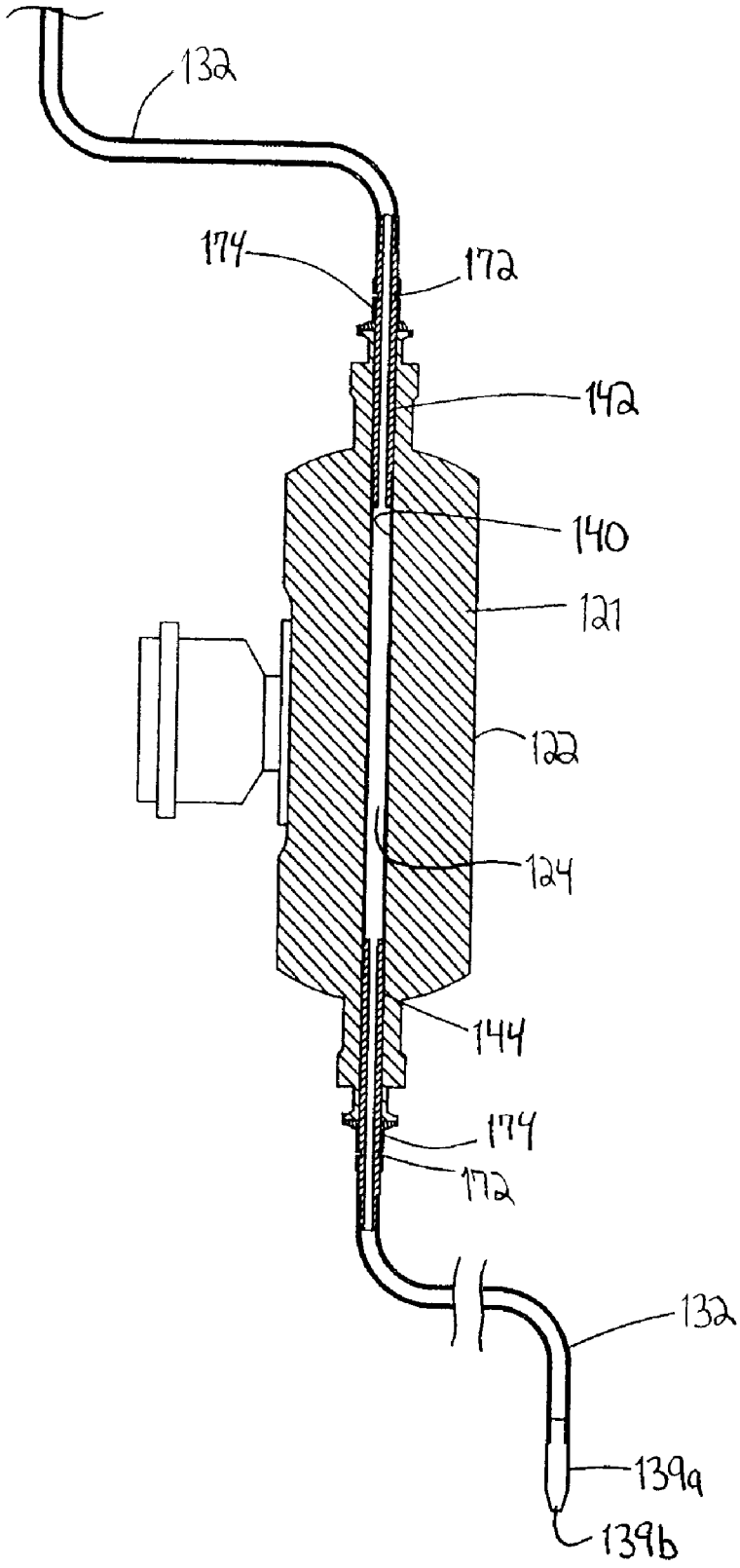
FIG. 6 is a cross section view of a flow meter and a fill line assembly of the filling machine FIG. 1.

Referring to FIG. 5, the bag filling station 78 further includes a corresponding mass flow meter 121. As illustrated in FIG. 6, the flow meter 121 includes an enclosed hollow cylinder 122 that defines a centrally located tubular passageway 124 that extends through ends of the cylinder 122. The cylinder 122 can contain nitrogen, helium or other gases to facilitate operation of the flow meter 121. In the illustrated embodiment, the flow meter 121 is a Coriolis flow meter such as a Coriolis flow meter available from Micro Motion, Endress+Hauser and others. The operation of a Coriolis flow measuring system is understood to one of ordinary skill in the art and is therefore not presented in detail in this application. In other embodiments, other flow measuring systems can also be used.

Referring to FIGS. 5 and 6, the filling machine 51 further includes a common disposable fill line assembly 126. In the illustrated embodiment, the fill line assembly 126 is substantially similar to one or more of the embodiments described in U.S. Patent Application Publication No. 2006/0010991, filed Jul. 14, 2005, the entire contents of which are hereby incorporated by reference herein.

The disposable fill line assembly 126 includes a solution filter 128, a manifold 130, and fill lines 132. The filter 128 defines an inlet 136 of the fill line assembly 126, and the illustrated filter 128 is coupled to a fluid supply 138 such that the inlet 136 of the fill line assembly 126 is in fluid communication with the fluid supply 138. The fluid supply 138 can be any suitable source of fluid, which may include biopharmaceuticals, pharmaceuticals, media solutions, other chemicals, foods and the like. In one method of operating the filling machine 51, the source of fluid is at a pressure above atmospheric pressure. In one such method, the pressure is above approximately 8 pounds per square inch (psi). In yet other methods of operating the filling machine 51, the pressure of the fluid is above approximately 8 psi and below about 85 psi. Of course, the filling machine 51 can be operated with the source of fluid at any suitable pressure.

The manifold 130 fluidly couples the filter 128 with the fill lines 132. While the illustrated fill line assembly 126 includes two fill lines 132 that correspond with the two container filling stations 78 (FIG. 1), it should be understood that the fill line assembly 126 can include any number of fill lines 132 to correspond to the number of container filling stations 78. Each of the fill lines 132 includes a nozzle 139*a* that defines an outlet 139*b* of the fill line assembly 126.

Figure 7:
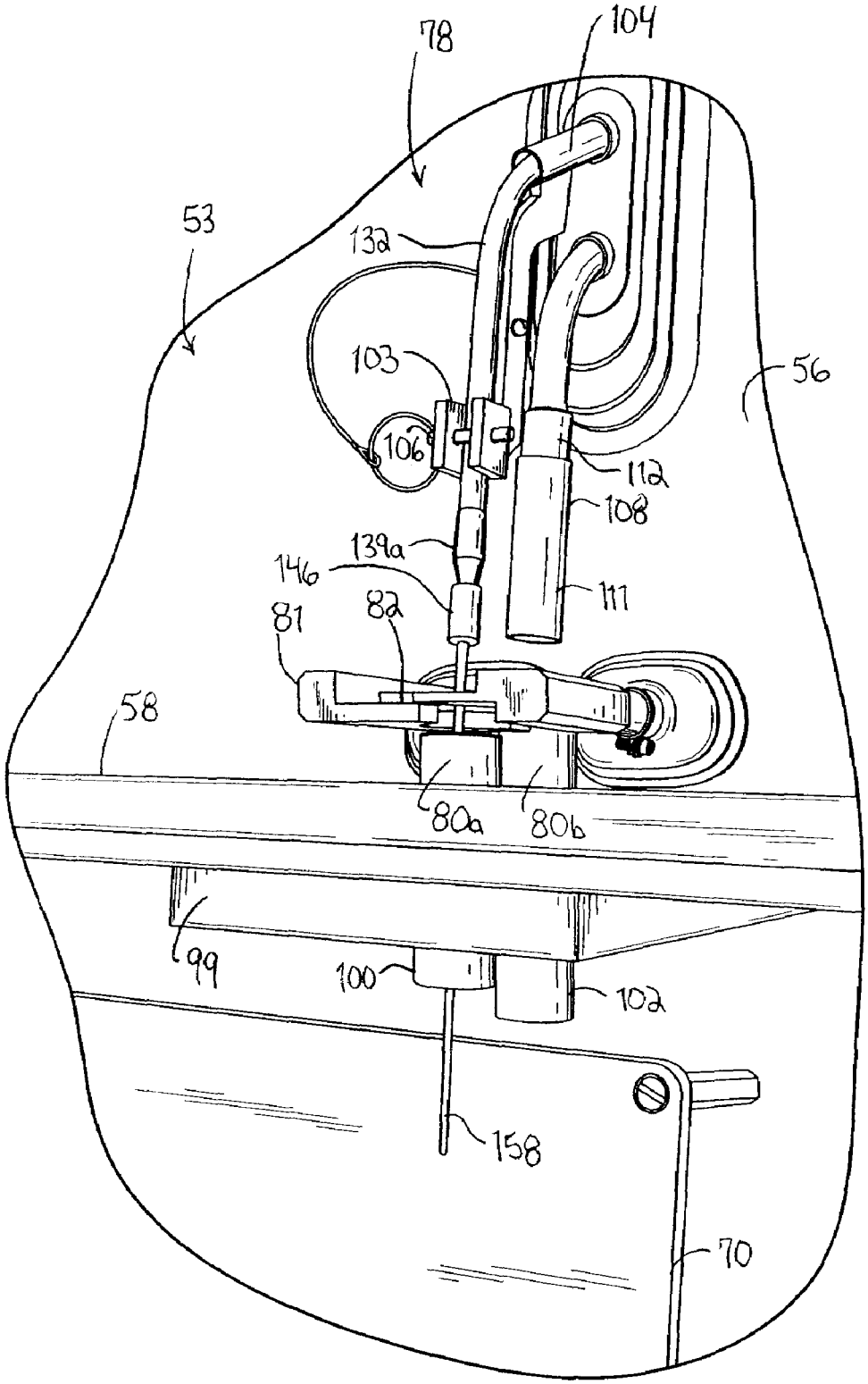
FIG. 7 is an enlarged view of the filling station of the filling machine of FIG. 1.
Figure 9:
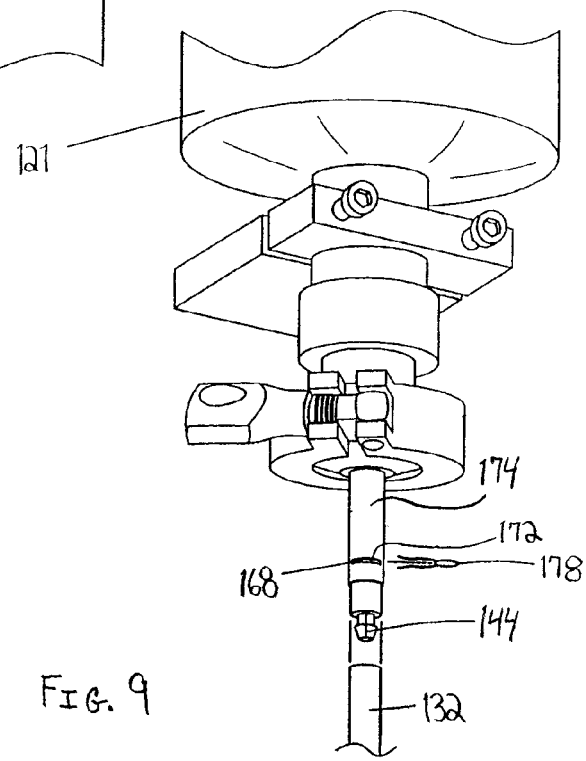
FIG. 9 is an enlarged view of a bottom portion of the flow meter and fill line assembly of the filling machine of FIG. 1.

Referring to FIGS. 6, 7, and 9, each fill line 132 further includes a mass flow meter liner portion 140. A top liner adapter 142 and a bottom liner adapter 144 fluidly couple the flow meter liner 140 within the fill line 132. Typically, the mass flow meter liner 140 has a smaller wall thickness and lower durometer value than the other portions of the fill line 132. The fill line 132 can be formed from flexible, semi-rigid, or rigid plastic tubing. For example, the fill lines 132 can be made of polyethylene, polypropylene, polyolefins, nylon, thermoplastic elastomer, or any combination of these materials. Other formable materials that are resistant to corrosive fluids can also be used. In some embodiments, the fill line 132 can be irradiated, washed, chemically sterilized, or the like. The illustrated fill line 132 includes a cover 146 (see FIG. 7) that is placed over the outlet 139*b* of the fill line assembly 126 after the fill line 132 and fill line assembly 126 are pre-sterilized and before being packaged to maintain sterility. The cover 146 substantially prevents contaminants from entering the fill line assembly 126 through the outlet 139*b*. The illustrated fill line 132 is made of commercially available thermoplastic elastomer C-FLEX medical grade tubing available from Consolidated Polymer Technologies, Inc. of Clearwater, Fla., however, other suitable tubing, conduit, liner and film materials can also be used. C-FLEX tubing is known for its bio-compatibility, temperature stability, moisture stability, sterile compatibility, and is made without toxic plasticizers, making it a good choice for pharmaceutical, chemical, and food packing applications.

Referring to FIG. 3, the illustrated filling machine 51 further includes a first pinch valve 148 and a second pinch valve 150 that correspond to one of the filling stations 78. The valves 148, 150 are configured to receive the fill line 132 when the fill line assembly 126 is installed into the filling machine 51. The illustrated first and second valves 148, 150 are air actuated pinch valves. However, it should be understood that any suitable valve can be utilized, such as butterfly, ball, or diaphragm valves.

Referring to FIG. 5, to install the disposable fill line assembly 126 in the filling machine 51, the fill line assembly 126 is first unwrapped from its packaging. The packaging is utilized to maintain the sterility of the fill line assembly 126 that can be pre-sterilized as discussed above. The solution filter 128 is slid into a filter bracket 154 and the inlet 136 of the fill line assembly 126, which is defined by the filter 128 in the illustrated embodiment, is coupled to the fluid supply 138.

The installation of the both fill lines 132 of the fill tube assembly 126 are substantially the same, and therefore only the installation of one of the lines 132 will be discussed in detail below. After the solution filter 128 is secured, the fill line 132 is straightened to remove any twisting in the fill line 132.

Referring to FIGS. 5-7, next, the fill line 132 is routed through the flow meter 121. In the illustrated construction, the end of the fill line 132 includes the nozzle 139*a* and the nozzle cover 146 having a lead 158 extending from the nozzle cover 146 (FIG. 7). The lead 158 is fed through the mass flow meter 121 from the top to the bottom and after the lead 158 is exposed from the bottom, the fill line 132 is pulled through the mass flow meter 121. In alternative constructions, the fill line 132 can be pulled through the mass flow meter 121 from the bottom of the flow meter 121 to the top of the follow meter 121. The fill line 132 is pulled until the mass flow meter liner 140 is positioned within the mass flow meter 121.

Figure 8:
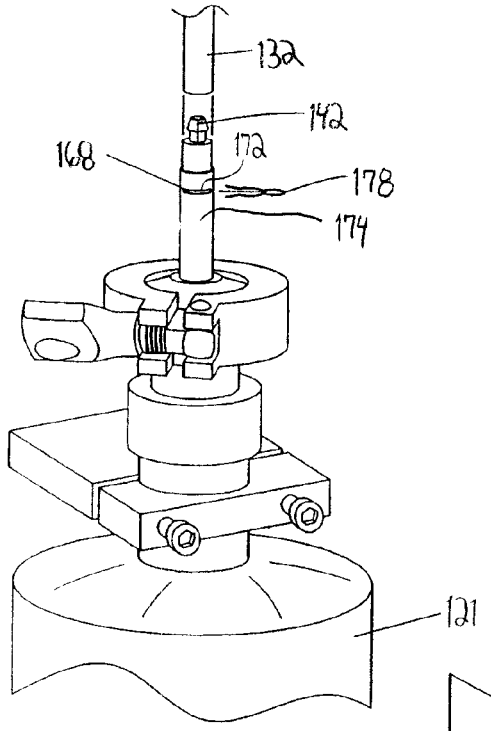
FIG. 8 is an enlarged view of a top portion of the flow meter and fill line assembly of the filling machine of FIG. 1.

With reference to FIGS. 6, 8 and 9, the mass flow meter liner 140 is connected within the fill line 132 through the top and bottom liner adapters 142, 144. The liner adapters 142, 144 each include radial alignment marks 168 such that the marks 168 can be aligned with notches 172 on the top and bottom liner holders 174 of the mass flow meter 121 to ensure that the liner 140 is not twisted within the mass flow meter 121. After the marks 168 on the adapters 142, 144 are properly aligned with the notches 172 of the holders 174, the adapters 142, 144 are secured to the holders 174 by sliding retaining clips 178 into the liner holders 174 to clip the liner adapters 142, 144 and liner 140 in place. It may be necessary to use a tie wrap to secure the connection between the fill line 132 and the top and bottom liner adapters 142, 144 so that these components do not disconnect when the fill line 132 is pressurized. Typically, the tie wrap is not pre-assembled because it would be difficult to pass through the constrained spaced within the mass flow meter 121.

After the flow meter liner 140 is secured in place, the fill line 132 is routed through an aperture 182 in a panel of the filling machine 51 (FIG. 5). Referring to FIG. 3, next, the fill line 132 is inserted into the tubular portion 104 of the fill line bracket 103 and carrier assembly 116 until the fill line 132 extends into the fill chamber 53 (FIG. 7). At this time, the protective viewing window 59 (FIG. 1) is removed by unlocking the latches 61 holdings it in place. When opened, the lead 158 is pulled to draw the fill line 132 and nozzle 139*a* through the tubular portion 104 (FIG. 7). As shown in FIG. 3, the fill line 132 is routed through the first and second pinch valves 148, 150 at the rear of the filling assembly 51.

Referring to FIG. 7, the nozzle 139*a* that defines the outlet 139*b* of the fill line assembly 126 is secured within the fill chamber 53 by coupling the nozzle 139*a* of the fill line 132 to the fill line bracket 103. First, the lead 158 is inserted through the aperture 79*a* (see FIG. 12) at the bottom of the fill chamber 53. Next, the nozzle 139*a* is positioned in the fill line bracket 103, and the pin 106 is then inserted through the aligned apertures 107 to secure the position of the nozzle 139*a* to the fill line bracket 103 and the carrier assembly 116.

Referring to FIG. 2, at this point, it may be necessary to use a tie wrap 186 to secure the connection between the fill line 132 and the nozzle 139*a* such that these components do not disconnect when the fill line 132 is pressurized. This particular tie wrap 186 is not pre-assembled because it would be difficult to pass through the constrained spaced of the tubular portion 104 of the fill line bracket 103, as well as through the mass flow meter 121.

Referring to FIGS. 1 and 7, the viewing window 59 is replaced and the lead 158 and nozzle cover 146 are then removed from the nozzle 139*a* by pulling on the lead 158 that is extending through the aperture 79*a*. After this step, the fill line 132 can be flooded and pressurized with the solution or fluid from the reservoir or fluid supply 138. The pressure of the fluid in the fluid supply 138 pressurizes the fill line 132, thereby expanding the flow meter liner 140 uniformly against the inner wall of the cylinder 122 that defines the passageway 121. The expansion of the flow meter liner 140 against the walls of the passage 121 facilitates proper operation of the flow meter 121. In the illustrated construction, it has been found that a pressure of the fluid of at least about 8 psi facilitates operation of the flow meter 121. In other constructions, the pressure of the fluid can be greater or less than 8 psi.

Referring to FIGS. 1 and 6, in order for the mass flow meter 121 to measure the fluid correctly, the meters 121 may need to be calibrated (also known as re-zeroed) by achieving an acceptable excitation current, drive gain, or frequency or other signal, which can be displayed on a controller display 190. When the calibration signal is outside the tolerance range, the solution in the fill lines 132 is purged to remove any air from the disposable fill line assembly 132. After a period of approximately ten minutes allowing the drive gain to stabilize, the drive gain should reach an acceptable level. If the drive gain does not reach an acceptable level by flooding the fill lines 132, the pressure of the solution supplied to the lines 132 should be increased and the calibration process repeated. After calibration is finished, the filling operation can begin.

Figure 10:
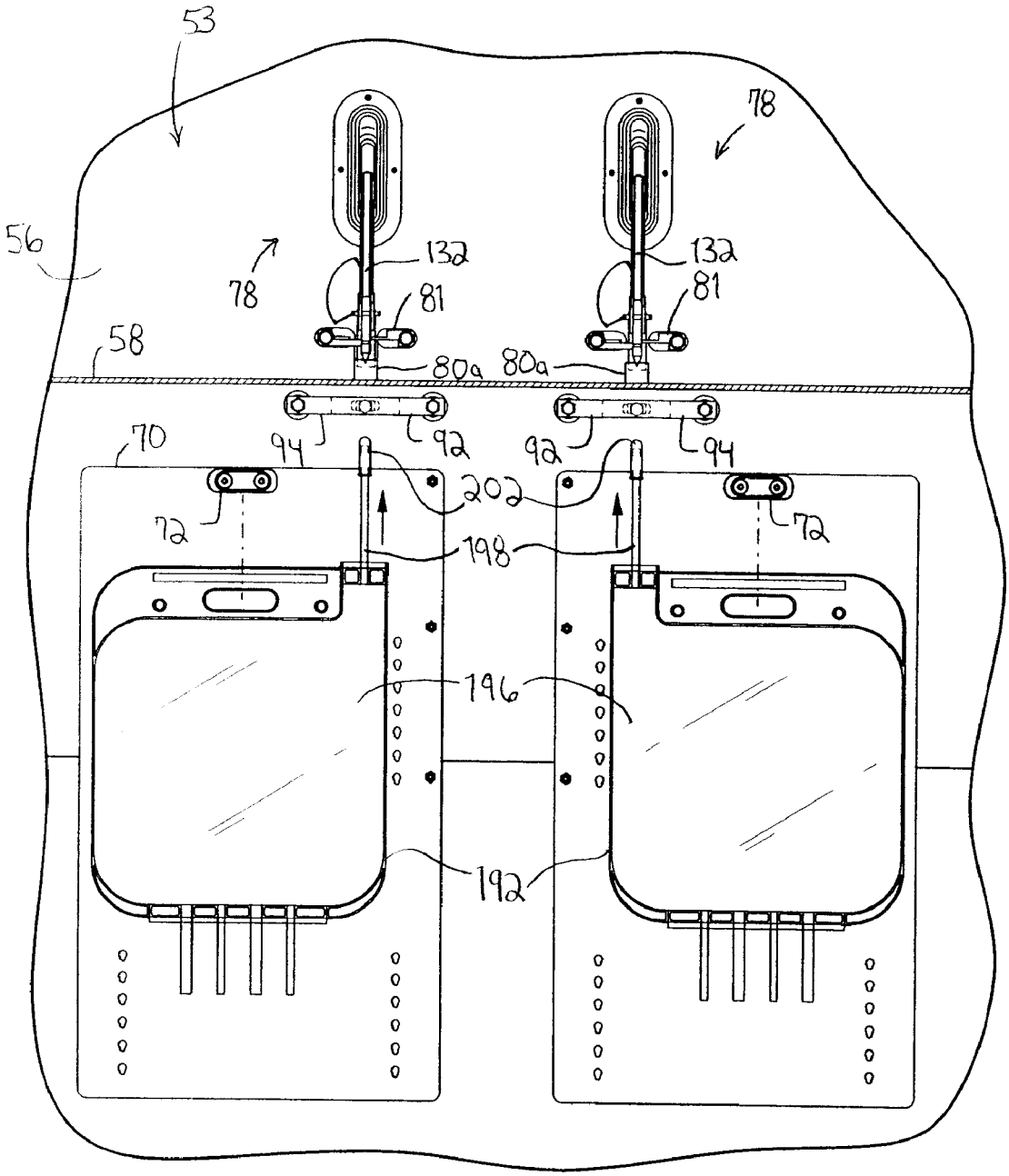
FIG. 10 is an enlarged from view of the filling station of FIG. 1 illustrating containers being inserted into a fill chamber.

Referring to FIG. 10, in operation, the filling machine 51 is operable to dispense a fluid or solution into a container, which in the illustrated construction is a bag 192. The illustrated bag 192 includes a body portion 196 and a fill conduit 198 that is in fluid communication with the body portion 196. The illustrated fill conduit 198 is a tubular member formed from a thermoplastic tube and in other constructions the fill conduit or fill tube 198 can take other forms. The fill conduit 198 defines an opening 200 (see FIG. 13), and the bag 192 further includes a cap 202 that cover the opening 200 and a portion of the fill conduit 198. It should be understood that FIG. 10 illustrates just one size bag or container that can be filled using the filling machine 51 and in other applications any suitable size bag or container can be utilized. For example, the illustrated filling machine 51 can fill containers ranging from about 25 ml to about 200 L. When large containers are filled using the filling machine 51, the bag support apparatus 70 may not be utilized and the container can rest directly on the ground.

Figure 11:
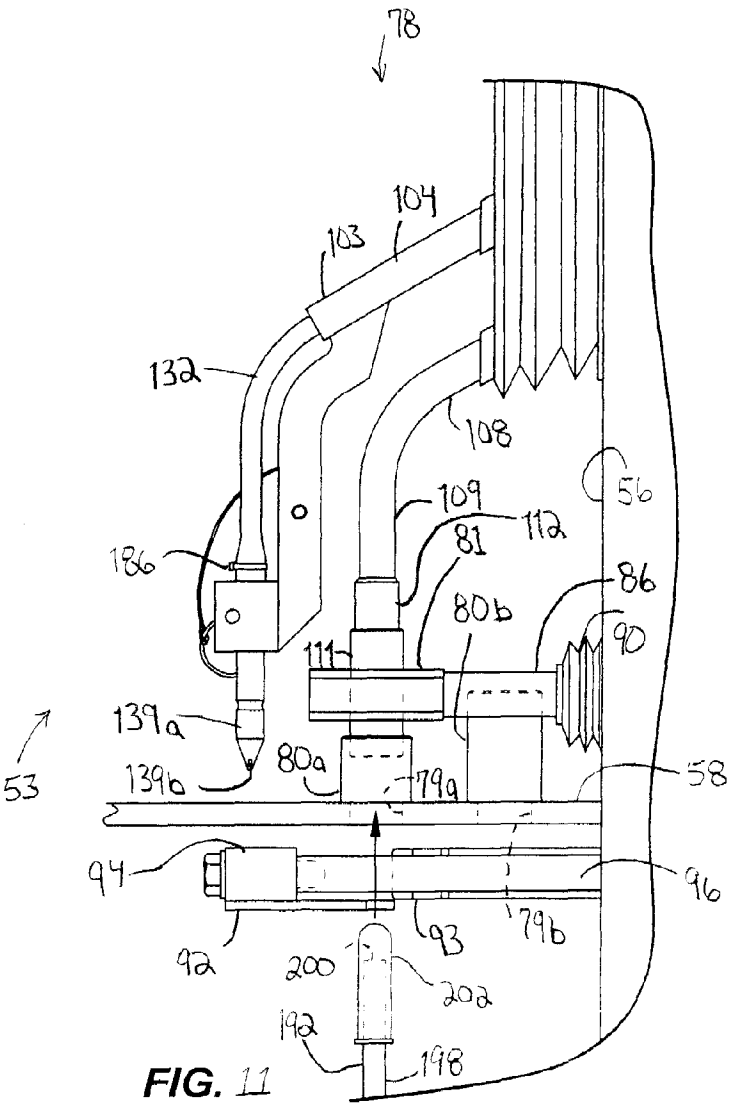

Referring to FIGS. 2 and 11, the filling machine 51 begins with the fill line bracket 103 and the cap removal tube 109 in a ready position. In the ready position, the cap removal tube 109 and the nozzle 139*a* are in a lowered position and both the tube support clamp 81 and the sealing assembly 92 are in the open position. Also, the cap removal tube 109 is aligned with the aperture 79*b* located at the bottom of the fill chamber 53 and the cap removal tube 109 is received within the sleeve 80*a*. The user inserts the fill conduit 198, which includes the cap 202, through the sleeve 100 of the cover 99 (FIG. 4) and then through the aperture 79*a* and the sleeve 80*a*.

Referring to FIG. 12, when the user inserts the cap 202 into the cap removal tube 109, the user can only insert the fill tube 198 of the bag 192 a predetermined distance into the fill chamber 53. Because the cap removal tube 109 is received within the sleeve 79*a*, the outer surface of the cap 202 is not exposed to the fill chamber 53. The cap removal tube 109 utilizes the vacuum created by the vacuum generation device to remove the cap 202 from the fill tube 148 and hold the cap 202 substantially within the first portion 11 of the cap removal tube 109. The largest outside diameter of the cap 202 is greater than the inside diameter of the second portion 112 of the cap removal tube 109, such that the cap 202 is prevented from traveling further into the second portion 112 of the cap removal tube 109 from the position illustrated in FIGS. 12 and 13. When the cap 202 has been removed from the fill tube 198, a change in pressure within the cap removal tube 109 is sensed by the filling machine 51 and the following filling sequence is automatically initiated. In other constructions, the filling machine 51 can include a foot pedal or foot activated switch. When the foot pedal is utilized, the filling machine 51 waits for the user to activate the foot pedal to initiate the filling sequence.

Figure 13:
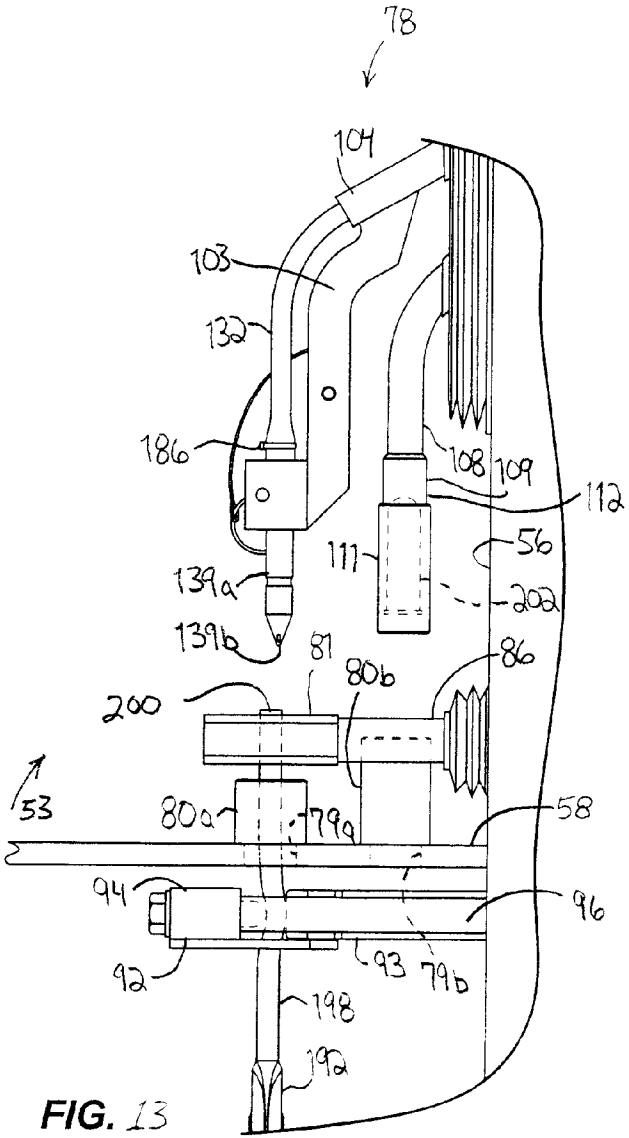

Referring to FIG. 13, next, the sealing assembly 92 moves to an intermediate position, such that the fill tube 198 is coupled between the members 93, 94 of the sealing assembly 92 without permanently sealing the fill tube 198. Then, the cap removal tube 109 and the nozzle 139*a* are moved in a vertical direction by the actuator 118 (FIG. 3) to an upper position. As illustrated in FIG. 13, the sleeve 80*a* surrounds a portion of the fill tube 198 such that only the portion of the fill tube 198 that was covered by the cap 202 is exposed to the fill chamber 53. In one application of the filling machine 51, the portion of the fill tube 198 that was covered by the cap 202 is not exposed to potential contamination after pre-irradiation of the bag 192 as discussed above. Therefore, only the portion of the fill tube 198 that was covered by the cap 202 is exposed within the fill chamber 53, and portions of the fill tube 198 that are exposed to potential contamination are surrounded by the sleeve 80*a* and remain outside of the fill chamber 53. As would be understood by one of skill in the art, it may be desirable to prevent portions of the bag 192, including the fill tube 198 and cap 202 that are exposed to potential contamination, from entering into the fill chamber 53.

Figure 15:
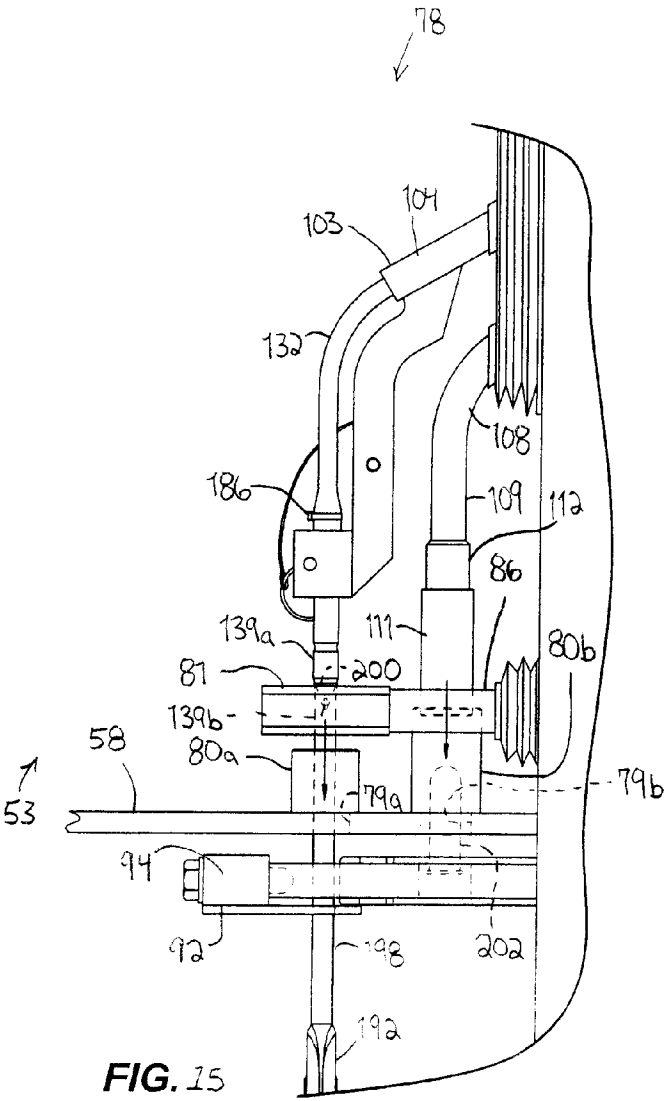

Next, the tube support clamp 81 moves in the directions of arrows 206 to a closed position to properly align and support the fill tube 198 (FIG. 14). The sensor 84 verifies that the fill tube 198 is in the correct position as illustrated in FIG. 14. Then, referring to FIG. 15, the tube sealing assembly 92 is moved back toward the open position and the nozzle 139*a* and the cap removal tube 109 is moved in a horizontal direction to a rear position. In the rear position, the nozzle 139*a* is aligned with the opening 200 of the fill tube 198. The nozzle 139*a* and the cap removal tube 109 are then moved to a lower position (FIG. 15), such that the nozzle 139*a* is partially received within the fill tube 198. Therefore, the outlet 139*b* of the nozzle 139*a* is in fluid communication with the fill tube 198. With the cap removal tube 109 in the position as shown in FIG. 15, such that the cap removal tube 109 is received within the sleeve 79*b*, the vacuum can be released and the cap 202 is ejected from the cap removal tube 109 using a blast of air such that the cap 202 will drop out of the fill chamber 53 and into a cap storage container 210 (FIG. 1). Meanwhile, the bag 192 is filled with the fluid or solution from the fluid supply 138 (see FIG. 5).

Because the cap removal tube 109 is partially received within the sleeve 80*b*, when the vacuum is released and the cap 202 drops out of the fill chamber 53 and into the cap storage container 210 (FIG. 1) the outside of the cap 202 is not exposed to the fill chamber 53. In one application of the filling machine 51, the outer surfaces of the cap 202 may not be sterilized. Therefore, it may be desirable not to expose the outside of the cap 202 to the fill chamber 53.

Referring to FIG. 5, the mass flow meter 121 measures the amount of fluid that is passed into the bag 192. Referring to FIG. 3, when the flow meter 121 measures that a predetermined amount of fluid has passed into the bag 192, the first pinch valve 148 is automatically moved to a closed position thereby pinching the fill line 132 to inhibit the flow of the fluid through the fill line 132. Then, the second pinch valve 150 is automatically moved to a closed position thereby pinching the fill line 132. Closing the second pinch valve 150 forces a portion of the fluid within the fill line 132 into the bag 192. The second pinch valve 150 then opens at a rate to draw a substantial portion of the fluid remaining in the fill line 132, downstream of the second valve 150, back upstream into the fill line 132 to substantially prevent fluid from dripping uncontrolled out of the nozzle 139*a* and into the fill chamber 53.

Figure 18:
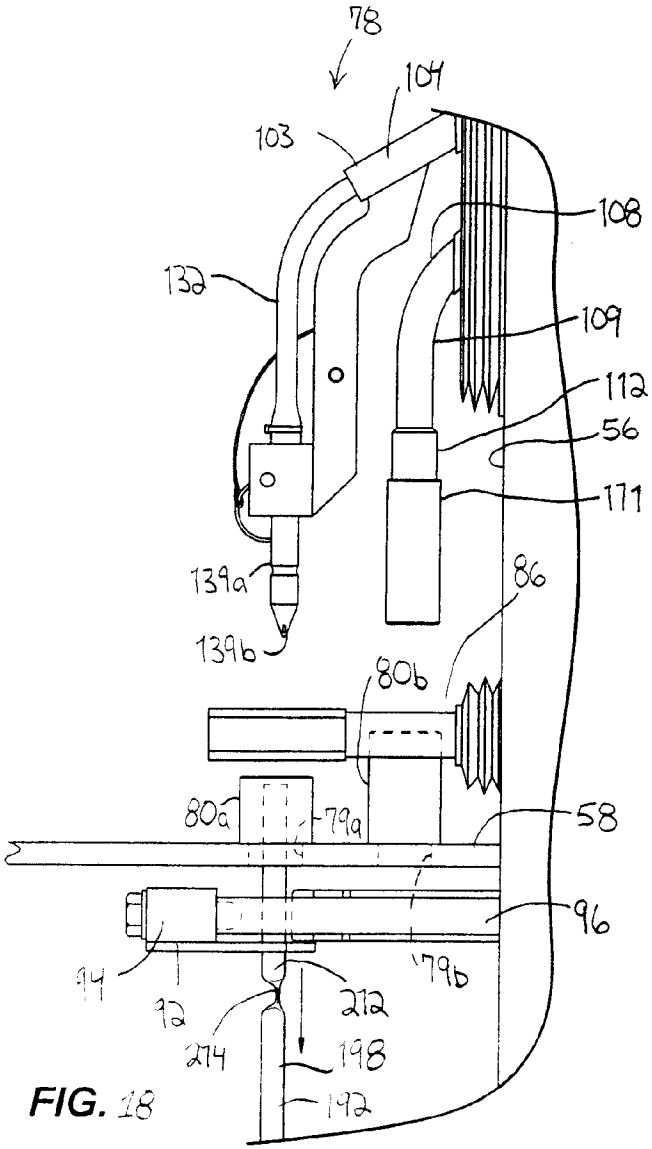
Figure 17:
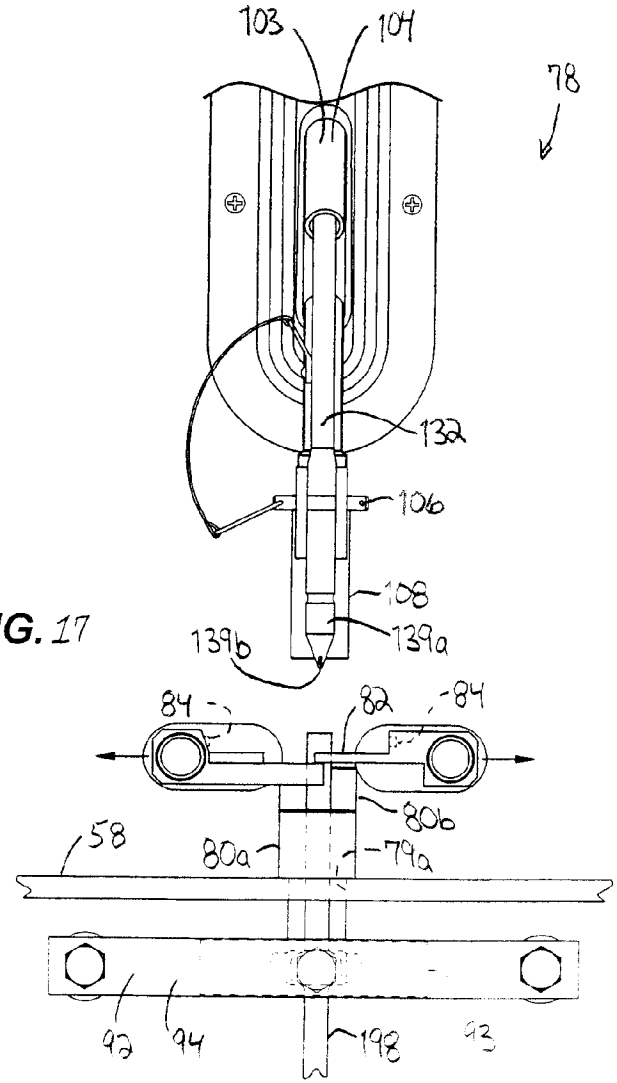

Referring to FIG. 16, next, the nozzle 139*a* and the cap removal tube 109 are moved vertically toward the upper position. Then, as seen in FIG. 16, the tube sealing assembly 92 closes and permanently seals the fill tube 198 utilizing a radio frequency seal. After the fill tube 198 is sealed, both the sealing assembly 92 and the tube support clamp 81 are moved to the open position (FIGS. 17 and 18). Referring to FIGS. 10 and 18, the bag 192 can then be removed from the bag support apparatus 70 and a portion 212 of the filling tube 198 located above the seal 214 (FIG. 18) can be removed by pulling on the portion 212 such that the seal 214 is located at the end of the fill tube 198. The nozzle 139*a* and the cap removal tube 109 can then be moved back to the ready position in order to fill additional bags or containers (FIG. 11).

The figures illustrate just one size of bag that can be filled using the filling machine 51. Referring to FIG. 1, the adjustable bag support 71 and the bag handle support 72 can be used to support bags of other sizes.

As discussed above and illustrated in FIG. 5, the filling machine 51 of the illustrated embodiment uses the disposable fill line assembly 126. The fill line assembly 126 is entirely plastic and inexpensive to manufacture, it can be disposed of after use (e.g., after the reservoir or fluid supply 138 is emptied or when a different type of fluid is utilized), thereby negating the need to clean, sterilize, and validate between batches. The disposable fill line assembly 126 is pre-irradiated and ready for use without further steaming or sterilization processing. The disposable fill line assembly 126, as previously discussed above, is an assembly of flexible tube portions and plastic connections affixed together by wire ties, plastic straps, or other connectors. In some embodiments, the disposable fill line 126 can be integrally connected together without the use of external mechanical fastening connectors, such as by heat sealing.

When the bag filling operation is completed, the disposable fill line assembly 126 can be removed so that a new batch of solution or fluid can be used with a new disposable fill line assembly without requiring additional sterilization and validation procedures to the filling machine 51. The installation process, discussed above, is essentially reversed to remove the disposable fill line assembly 126 from the filling machine 51. Referring to FIGS. 1 and 5, to remove the fill line assembly 126, the viewing window 59 is removed and covers are positioned on the nozzles. This cover can be similar to the nozzle cover 146 (see FIG. 7) described in reference to the installation of the fill line assembly 126 except that the lead 158 is not necessary. The cover will help to deter any solution from leaking from the nozzle 139*a* while the fill line assembly 126 is removed from the filling machine 51.

At this point, during removal of the fill line assembly 126, it may be necessary to remove any tie wraps 186 (see FIG. 2) connecting the fill line 132 and the nozzle 139*a*. After the tie scrap 186 is removed, the pin 106 is removed from the fill line bracket 103 and the nozzle 139*a* is removed from the fill line bracket 103. The nozzle 139*a* is then passed through the tubular portion 104 of the fill line bracket 103 to the rear of the filling machine 51. Referring to FIG. 3, at the back of the filling machine 51, the fill line 132 is removed from the first and second pinch valves 148, 150 and then pulled out of the aperture 182 (FIG. 5) in the back panel of the filling machine 51.

Referring to FIGS. 5, 6, 8, and 9, next, the mass flow meter liner 140 is ready to be removed from the mass flow meter 121. First, the clips 178 are removed from the top and bottom liner holders 174. At this point, it may be necessary to remove any tie wraps connecting the fill line 132 and the lower adapter 144. After the clips 178 are removed, the fill line 132 can be pulled out of the mass flow meter 121 from the top of the mass flow meter 121.

Finally, the solution filter 128 is disconnected from the fluid supply 138, and the solution filter 128 is removed from the filter bracket 154. At this point, the fill line assembly 126 including the fill lines 132 can be properly discarded, and a new pre-irradiated fill line assembly can be installed for use with the next batch of solution.

Referring to FIG. 11, often it may be desirable to minimize portions of the bag 192 that are not sterilized from exposure to the fill camber 53. The illustrated filling machine 51 includes features that minimize portions of the bag 192 that may not be sterilized, such as the outer surfaces of the cap 202 and the fill conduit or tube 198, from exposure to the fill chamber 53. For example, in the illustrated construction, the filling machine 51 generally does not expose the outer surface of the cap 202 to the fill chamber 53. In addition, the portion of the bag fill tube 198 that is exposed to the fill chamber 53 is generally limited to a portion of the fill tube 198 that was beneath the cap 202, which is not exposed to potential contamination after the bag 192 is irradiated. In one method of manufacturing the bag 192, the bag 192, including the cap 202, is irradiated then packaged into sterile packaging that includes two bags or wrappers. The packaged bags are stored in a box for shipment. In one method of operating the filling machine 51, the filling machine 51 is located in a clean room. The first or outer wrapper that surrounds the bag 192 is removed prior to entering the clean room and the second or inner wrapper is removed when the bag 192 is in the clean room. When the bag 192 is removed from the inner wrapper for insertion into the filling machine 51 outer surfaces of the bag 192 are exposed to potential contamination except for the portion of the fill tube 198 that is beneath the cap 202. Therefore, when the cap 202 is removed from the fill tube 198 within the fill chamber 53, the portion of the fill tube 198 previously covered by the cap 202 remains sterile and only a portion of the fill tube 198 that was beneath the cap 202 is exposed to the fill chamber 53 (see FIGS. 12 and 13).

Various features and advantages of the invention are set forth in the following claims.

What is claimed is:

1. A filling machine operable to dispense a fluid from a fluid supply to a container having an opening and a cap configured to cover the opening, the filling machine comprising:

a housing that defines a fill chamber;

a cap removal assembly at least partially located within the fill chamber and operable to remove the cap from the opening of the container within the fill chamber;

a fill line assembly having an inlet and an outlet, the inlet configured to be coupled to the fluid supply, the outlet located within the fill chamber and the outlet configured to be placed in fluid communication with the opening of the container, wherein the fill line assembly is removably coupled to the filling machine, and wherein fluid flowing from the fluid supply to the container flows through the fill line assembly; and a flow meter including a passageway through which the fluid flows, the flow meter being operable to measure the fluid flowing through the passageway, wherein the fill line assembly includes a liner portion positioned within the passageway, the liner portion being removably coupled with the flow meter such that fluid flowing through the passageway flows through the liner portion without contacting an inner surface of the passageway.

2. The filling machine of claim 1, wherein fluid flowing from the inlet of the fill line assembly to the container flows through the fill line assembly without directly contacting the filling machine except for the fill line assembly.

3. The filling machine of claim 1, wherein the fill line assembly includes plastic tubing.

4. The filling machine of claim 1, further comprising a valve operable to substantially inhibit a flow of the fluid through the fill line assembly, wherein the fill line assembly includes a portion positioned within the valve, the fill line assembly being removably coupled to the valve such that fluid flowing through the valve flows through the fill line assembly without directly contacting the valve.

5. The filling machine of claim 4, wherein the fill line assembly includes flexible tubing, and wherein the valve is a pinch valve operable to pinch the flexible tubing to substantially inhibit the flow of the fluid through the fill line assembly.

6. The filling machine of claim 1, wherein the container defines a body portion and a fill conduit extending from the body portion, the fill conduit in fluid communication with the body portion, wherein the opening of the container is defined by the fill conduit, and wherein the housing further defines an aperture in fluid communication with the fill chamber and configured to receive the fill conduit of the container such that the body portion of the container does not enter the fill chamber.

7. The filling machine of claim 1, wherein the fill line assembly includes a nozzle configured to be at least partially received by the opening of the container.

8. The filling machine of claim 1, wherein the cap removal assembly includes a hollow member that receives the cap, the filling machine further comprising a vacuum generator operable to generate a vacuum within the hollow member to remove the cap from the container.

9. The filling machine of claim 8, wherein the cap removal assembly is operable to transport the removed cap to a cap disposal container.

10. The filling machine of claim 1, wherein insertion of the cap into the cap removal assembly initiates a filling sequence of the filling machine.

11. The filling machine of claim 1, further comprising a carrier assembly, wherein the fill line assembly includes a nozzle that defines the outlet, the nozzle removably coupled to the carrier assembly for movement with the carrier assembly, and wherein a portion of the cap removal assembly is coupled to the carrier assembly for movement with the carrier assembly and the nozzle.

12. The filling machine of claim 1, further comprising an air handling unit in fluid communication with the fill chamber and operable to supply air to the fill chamber such that the fill chamber is at a positive pressure.

13. The filling machine of claim 1, wherein the container includes a body portion and a fill conduit extending from the body portion, the fill conduit defining the opening of the container, the filling machine further comprising a conduit sealing assembly operable to seal the fill conduit.

14. The filling machine of claim 13, wherein the conduit sealing assembly includes a radio frequency sealer.

15. The filling machine of claim 13, wherein the conduit sealing assembly is substantially located outside of the fill chamber.

16. A filling machine operable to dispense a fluid from a fluid supply to a container having a body portion and a fill conduit extending from the body portion, the fill conduit defining an opening of the container, the filling machine comprising:

a housing that defines a fill chamber and an aperture configured to receive the fill conduit to position at least a portion of the fill conduit within the fill chamber;

a conduit sealing assembly operable to seal the fill conduit; a fill line assembly having an inlet and an outlet, the inlet configured to couple to the fluid supply, the outlet located within the fill chamber and the outlet configured to be placed in fluid communication with the opening of the container, wherein the fill line assembly is removably coupled with the filling machine, and wherein fluid flowing from the fluid supply to the container flows through the fill line assembly; and a flow meter including a passageway through which the fluid flows, the flow meter being operable to measure an amount of fluid flowing through the passageway, wherein the fill line assembly includes a liner portion positioned within the passageway, the liner portion being removably coupled with the flow meter such that fluid flowing through the passageway flows through the liner portion without contacting an inner surface of the passageway.

17. The filling machine of claim 16, wherein fluid flowing from the inlet of the fill line assembly to the contain flows through the fill line without directly contacting the filling machine except for the fill line assembly.

18. The filling machine of claim 16, wherein the conduit sealing assembly includes a radio frequency sealer.

19. The filling machine of claim 16, wherein the conduit sealing assembly utilizes a heat sealer.

20. The filling machine of claim 16, wherein the conduit sealing assembly includes a first member and a second member movable with respect to the first member, the first and second members operable to pinch the fill conduit to facilitate sealing the fill conduit.

21. The filling machine of claim 16, wherein the conduit sealing assembly is substantially located outside of the fill chamber.

22. The filling machine of claim 16, wherein the conduit sealing assembly includes a portion located within the fill chamber.

23. The filling machine of claim 16, wherein the fill line assembly includes plastic tubing.

24. The filling machine of claim 16, further comprising a valve operable to substantially inhibit a flow of the fluid through the fill line assembly, wherein the fill line assembly includes a portion positioned within the valve, the fill line assembly being removably coupled with the valve such that fluid flowing through the valve flows through the fill line assembly without directly contacting an inner surface of the valve.

25. The filling machine of claim 24, wherein the fill line assembly includes flexible tubing, and wherein the valve is a pinch valve operable to pinch the flexible tubing to inhibit the flow of the fluid.

* * * * *